US009881594B1

(12) United States Patent
Farago

(10) Patent No.: US 9,881,594 B1
(45) Date of Patent: Jan. 30, 2018

(54) DYNAMIC DRUM BEATER

(71) Applicant: Richard L. Farago, Westford, MA (US)

(72) Inventor: Richard L. Farago, Westford, MA (US)

( * ) Notice: Subject to any disclaimer, the term of this patent is extended or adjusted under 35 U.S.C. 154(b) by 0 days.

(21) Appl. No.: 15/635,539

(22) Filed: Jun. 28, 2017

Related U.S. Application Data

(63) Continuation of application No. 15/256,777, filed on Sep. 6, 2016.

(51) Int. Cl.
*G10D 13/00* (2006.01)
*G10D 13/02* (2006.01)

(52) U.S. Cl.
CPC ..... *G10D 13/006* (2013.01); *G10D 13/003* (2013.01); *G10D 13/02* (2013.01); *G10D 13/00* (2013.01)

(58) Field of Classification Search
CPC ..... G10D 13/006
USPC ..... 84/422.4, 422.1
See application file for complete search history.

(56) References Cited

U.S. PATENT DOCUMENTS 1,343,163 A * 6/1920 Smith ..... G10D 13/006 84/422.1
1,479,376 A * 1/1924 Danly ..... G10D 13/006 84/422.2
2,132,211 A * 10/1938 Hueckstead ..... G10D 13/006 84/422.1
2,484,302 A * 10/1949 Laverents ..... G10D 13/006 84/422.1
2,551,635 A * 5/1951 Ramsey ..... G10D 13/006 84/422.1
2,784,635 A * 3/1957 Troppe ..... G10D 13/006 84/422.1
2,822,717 A * 2/1958 Slawienski ..... G10D 13/006 84/422.1
2,893,284 A * 7/1959 Washington, Jr. ... G10D 13/006 74/512
3,316,792 A * 5/1967 Ippolito ..... G10D 13/006 84/422.1
3,411,395 A * 11/1968 Hanes ..... G10D 13/003 84/422.4

(Continued)

FOREIGN PATENT DOCUMENTS

GB 930418 A * 7/1963 ..... B25D 3/00
GB 1385188 A * 2/1975 ..... G10D 13/006

*Primary Examiner* — David Warren
*Assistant Examiner* — Christina Schreiber
(74) *Attorney, Agent, or Firm* — Richard Malagiere, Esq.

(57) ABSTRACT

A drum beater shaft with a flexible coupling means disposed between the base portion of the shaft and the head portion of the shaft is disclosed. The base portion of the shaft is fixed and hingedly attached, typically, to a pedal operated actuator. The head portion of the shaft contains a striking device used to contact the drum when actuated by the pedal. In one preferred embodiment, the flexible coupling means disposed between the base portion and head portion of the drum beater shaft takes the form of a spring surrounded by an elastic sheath. In another preferred embodiment, the flexible coupling means takes the form of a universal joint surrounded by an elastic sheath, In yet another preferred embodiment, the flexible coupling means takes the form of a ball an socket joint surrounded by and elastic sheath.

6 Claims, 8 Drawing Sheets

(56) References Cited

U.S. PATENT DOCUMENTS

D249,820 S * 10/1978 Clark ..... D17/22
4,520,710 A * 6/1985 Elliott, Jr. ..... G10D 13/006 84/422.1
4,538,499 A * 9/1985 Livingston ..... G10D 13/006 84/422.1
4,644,842 A * 2/1987 Aluisi ..... G10D 13/006 84/422.1
4,651,617 A * 3/1987 Schwartz ..... G10D 13/003 84/422.4
4,970,934 A * 11/1990 Reed ..... G10D 13/003 84/422.4
5,350,881 A * 9/1994 Kashio ..... G10H 1/34 84/622
5,477,768 A * 12/1995 Swift ..... G10D 13/003 84/422.4
5,503,056 A * 4/1996 Evans ..... G10D 13/003 84/422.4
5,526,728 A * 6/1996 Behrenfeld ..... G10D 13/003 84/422.1
5,763,798 A * 6/1998 Chen ..... G10D 13/003 84/422.1
5,817,962 A * 10/1998 Behrenfeld ..... G10D 13/003 84/422.1
5,998,718 A * 12/1999 Liao ..... G10D 13/006 84/422.1
6,162,979 A * 12/2000 Gauger ..... G10D 13/003 84/402
6,166,312 A * 12/2000 Brewster ..... G10D 13/006 84/422.1
6,271,451 B1 * 8/2001 Gress ..... G10D 13/003 84/422.4
6,310,278 B1 * 10/2001 Butler ..... G10D 13/003 84/422.4
6,365,813 B1 * 4/2002 Gress ..... G10D 13/003 84/422.4
7,211,720 B1 * 5/2007 Dorfman ..... G10D 13/006 84/422.1
7,812,237 B1 * 10/2010 Dunnett ..... G10D 13/006 84/422.1
8,674,204 B2 * 3/2014 Rundle ..... G10D 13/003 84/422.1
9,012,751 B2 * 4/2015 Ruttenberg ..... G10D 13/003 84/422.4
9,378,713 B1 * 6/2016 Smith ..... G10D 13/006
2004/0025666 A1 * 2/2004 Mizuno ..... G10D 13/003 84/422.4
2006/0243118 A1 * 11/2006 Malott ..... G10D 13/003 84/422.4
2007/0089588 A1 * 4/2007 Dorfman ..... G10D 13/006 84/322
2009/0084246 A1 * 4/2009 Grover ..... G10D 13/003 84/422.4
2011/0067554 A1 * 3/2011 Taninbaum ..... G10D 13/003 84/422.4
2013/0291707 A1 * 11/2013 Ruttenberg ..... G10D 13/003 84/422.4

* cited by examiner

DYNAMIC DRUM BEATER

PRIORITY

This application is a continuation in part and claims priority to U.S. Nonprovisional application Ser. No. 15/256,777 filed Sep. 6, 2016.

BACKGROUND OF INVENTION

The present invention is directed to a dynamic drum beater. Conventional bass drum beaters are inserted into bass drum pedals and used to strike the bass drum. Bass drum beaters have felt, wood or plastic beaters and chrome, steel metal shafts. The dynamic drum beater is based on a conventional beater; however, differs drastically because it utilizes a spring and damper arrangement to aid the performer in striking the drum resulting in a lift in rebound which enhances the upstroke. Capitalizing on the energy of a spring to aid the performer and rebound off of the drum. The end of the beater (where it impacts the drum) uses a conventional felt, wood or plastic tip or essentially any material used to strike drums.

The prior art discloses a drum stick with a spring coupling between the handle portion and the impacting portion. The spring can be locked so as to make the handle and impacting portion of the stick fixed. The prior art further discloses a ball fitted to a compression spring actuated be electric current for use with a Xylophone. Also disclosed in the prior art, is a thimble device which fits over the fingers of the player of a Glockenspiel, or similar instrument, where a small metal spring projects from the end of the thimble to which a wooden button is attached. The prior art also makes known the use of a spring loaded base drum assembly where the spring works to return the drum stick and head away from the drum face when the foot pedal is released.

The present invention differs from the prior art in one preferred embodiment of the present invention which employs a spring between the hinged portion of the beater shaft and the impact portion of the beater shaft with a damping cover means fitted over the spring to stiffen the assembly and provide the desired flexibility when used. In a second preferred embodiment of the present invention, a universal joint is employed between the hinged portion of the beater shaft and the impact portion of the beater shaft with a spring cover means fitted over the universal joint to stiffen the assembly and provide the desired flexibility when used. In yet a third preferred embodiment of the present invention, a ball and socket joint is employed with a spring cover means fitted over the ball and socket joint to stiffen the assembly and provide the desired flexibility when used.

BRIEF SUMMARY OF INVENTION

A dynamic drum beater comprising a shaft with a head portion and a base portion, the head portion of the shaft adapted to receive a drum striking attachment, the base portion of the shaft adapted to receive a pivotal attachment of an actuator mechanism, a flexible joint disposed between the head portion and base portion of the shaft to provide vibration of the drum striking attachment on the drum.

DRAWINGS

DETAILED DESCRIPTION OF INVENTION

Figure 1:
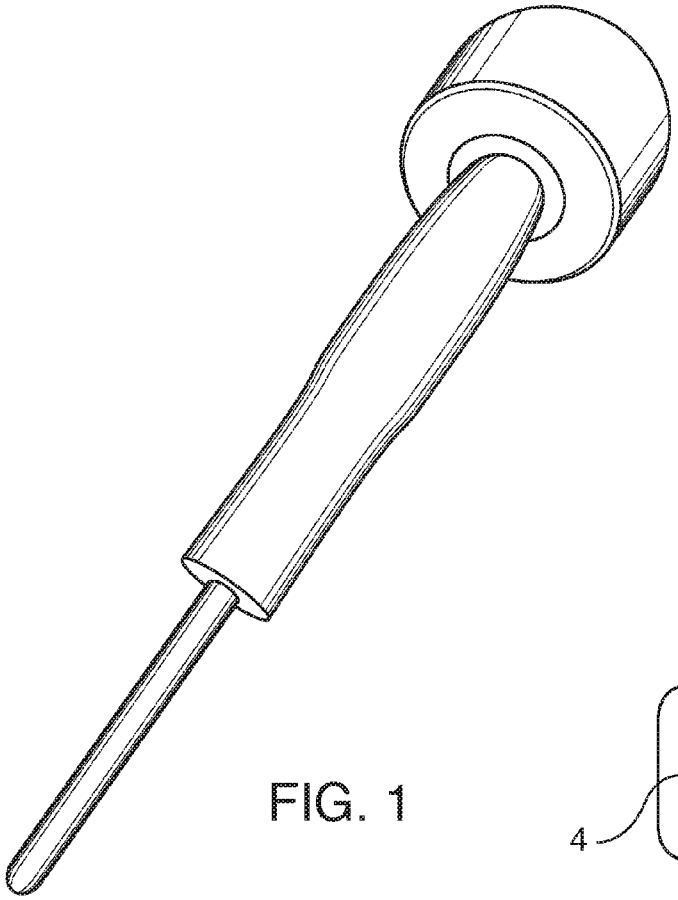
FIG. 1 is an isometric view of a preferred embodiment of the present invention.

The present invention will now be described in terms of the presently preferred embodiment thereof as illustrated in the drawings. Those of ordinary skill in the art will recognize that many obvious modifications may be made thereto without departing from the spirit or scope of the present invention.

The present invention is directed to address the short comings in an arrangement where a spring or other flexible joint is inserted between the fixed-end and the striking end of a drum stick. These arrangements provide the bounce back when the striking end of the drum stick comes in contact with the drum, but do not effectively control it. Specifically, the striking end of the drum stick—in the single spring configuration—bounces back in a non-linear and generally uncontrolled manner. This is especially true in the ball joint and universal joint embodiments when the outer elastic housing is not used.

One series of preferred embodiments of the present invention is directed to solve the uncontrolled and non-liner bounce back disclosed in the prior art by the use of an elastic sheath surrounding the joint in the drum stick. In this series of preferred embodiments, the elastic sheath surrounding the joint acts as a stiffener and damper (i.e., in the spring configuration); a stiffener, a spring and a damper (i.e., in the universal joint configuration) and a stiffener, a spring and a damper (i.e., in the ball joint configuration).

An isometric view of one preferred embodiment of the present invention is shown at FIG. 1. FIG. 1 depicts a typical bass drum beater device. However, the device could easily be adapted—without departing from the spirit and intent of the present invention—for use in a drum stick to be held in the hand of the user.

Figure 2:
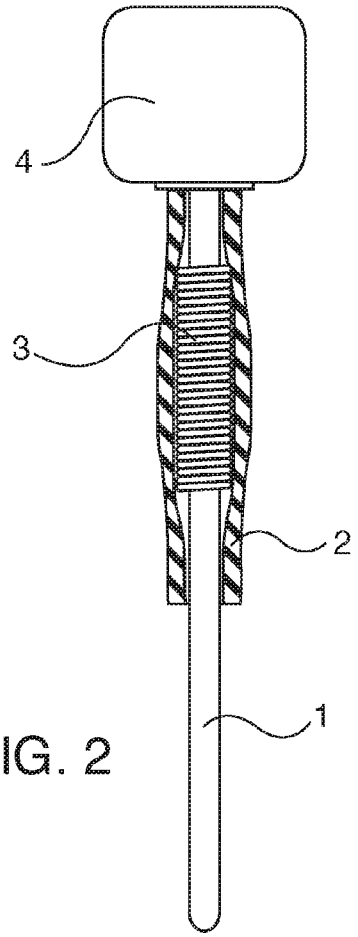
FIG. 2 is a cross section of a preferred embodiment of the present invention.
Figure 5:
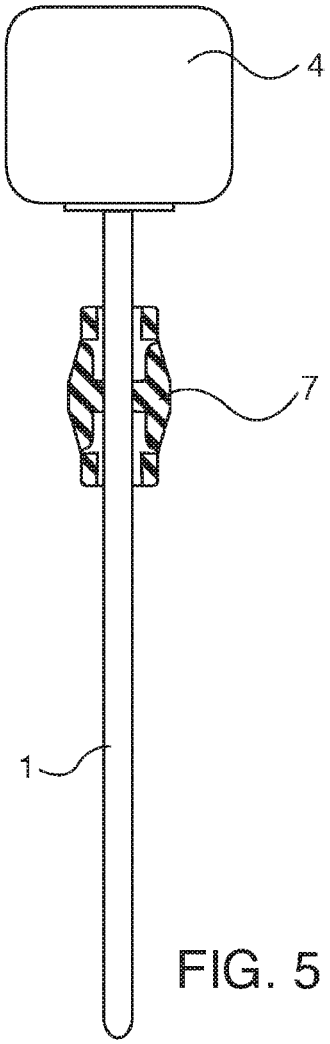
FIG. 5 is a cross section of a preferred embodiment of the present invention.

In a preferred embodiment of the present invention, a spring 3 is disposed at the head of shaft 1. FIG. 2. The base of the shaft 1 is used to fix the shaft to a foot pedal device (FIG. 5). The drum beater device 4 could be any traditional beater device or material (e.g., felt, wood, composite, synthetic) typically used. The spring 3 is wrapped with an elastic sheath 2 to provide damping to the spring 3 and stiffness to the spring/elastic sheath assembly. FIG. 2. The elastic sheath 2 is made from an elastic material such as rubber, synthetic rubber or polymer. The operator of a typical foot bass drum arrangement, would attach the base of shaft 1 to a foot pedal device (FIG. 5) and use that device to actuate the present invention (FIG. 1) and strike the bass drum with the drum beater device 4.

Figure 3:
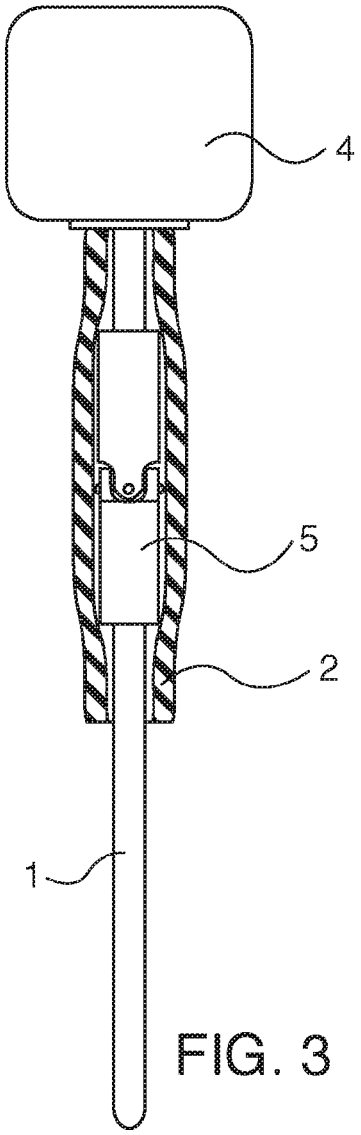
FIG. 3 is a cross section of a preferred embodiment of the present invention.
Figure 3A:
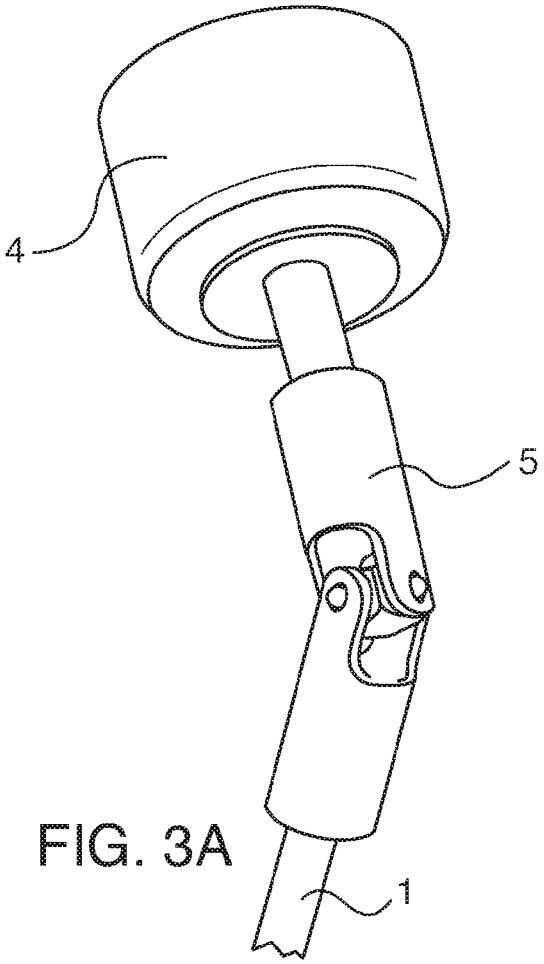
FIG. 3A is an isometric view of a preferred embodiment with the outer wrap removed.

In another preferred embodiment of the present invention, a universal joint 5 is disposed at the head of shaft 1. FIG. 3 and FIG. 3A. The base of the shaft 1 is used to fix the shaft to a foot pedal device (FIG. 5). A drum beater device 4 is affixed to the head of the shaft 1. The universal joint 5 is wrapped with an elastic sheath 2 to provide spring and damping to the universal joint 5 and stiffness to the universal joint/elastic sheath assembly. FIG. 3. The operator of a typical foot bass drum arrangement, would attach the base of shaft 1 to a foot pedal device (FIG. 5) and use that device to actuate the present invention (FIG. 1) and strike the bass drum with the drum beater device 4.

Figure 4:
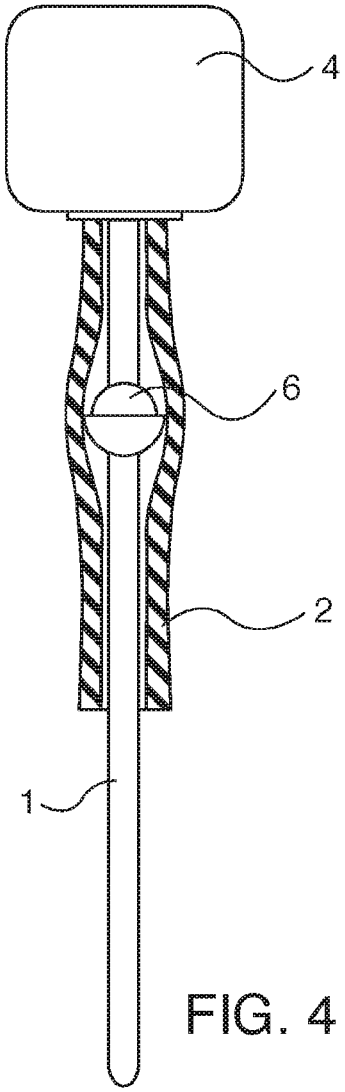
FIG. 4 is a cross section of a preferred embodiment of the present invention.
Figure 4A:
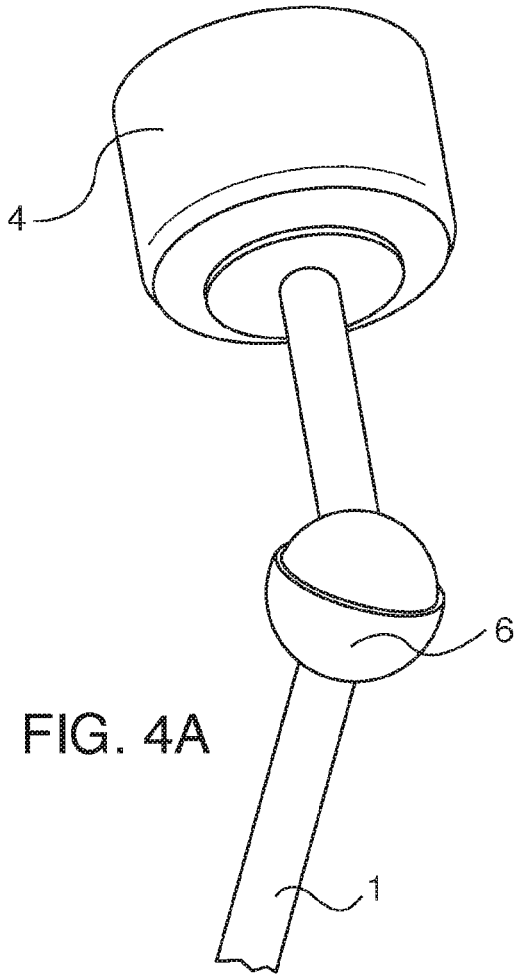
FIG. 4A is an isometric view of a preferred embodiment with the outer wrap removed.

In yet another preferred embodiment of the present invention, a ball and socket joint 6 is disposed between the head and base of shaft 1. FIG. 4 and FIG. 4A. The base of the shaft 1 is used to fix the shaft to a foot pedal device (FIG. 5). A drum beater device 4 is affixed to the head of shaft 1. The universal joint 6 is wrapped with an elastic sheath 2 to provide spring and damping to the ball and socket joint 6 and stiffness to the ball and socket/elastic sheath assembly. FIG. 4. The operator of a typical foot bass drum arrangement, would attach the base end of shaft 1 to a foot pedal device (FIG. 5) and use that device to actuate the present invention (FIG. 1) and strike the bass drum with the drum beater device 4.

Figure 5A:
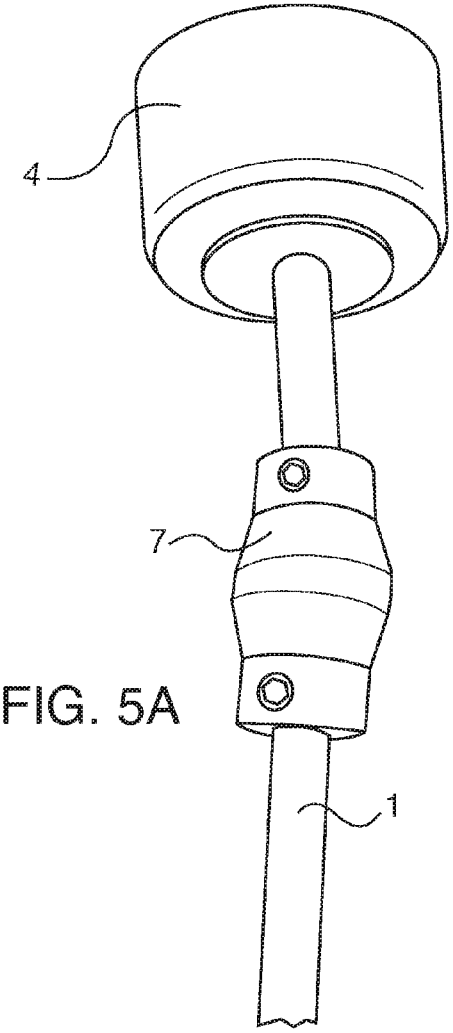
FIG. 5A is an isometric view of a preferred embodiment.
Figure 7:
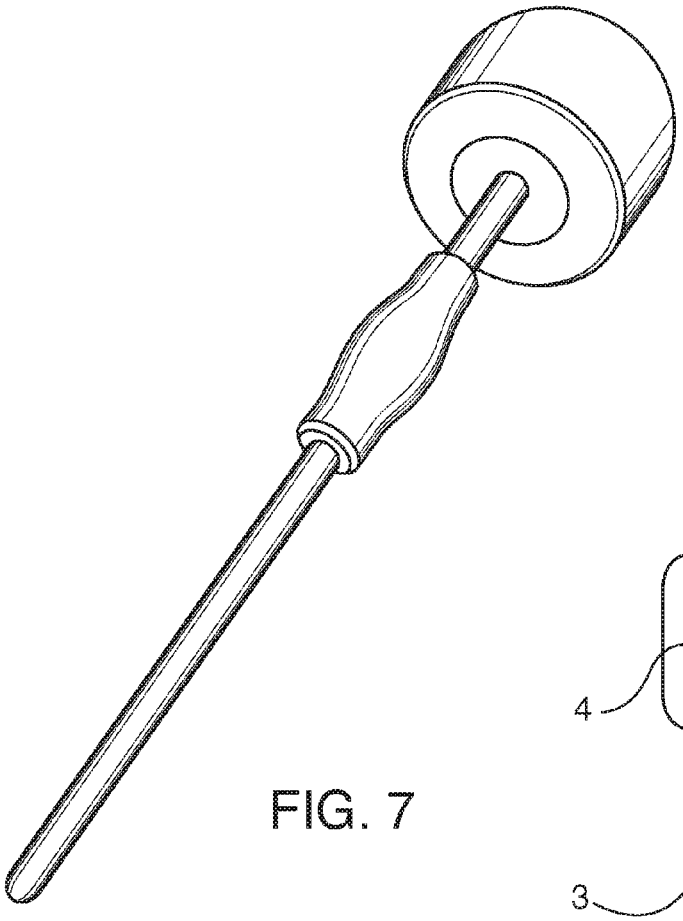
FIG. 7 is an isometric view of a preferred embodiment of the present invention.
Figure 7A:
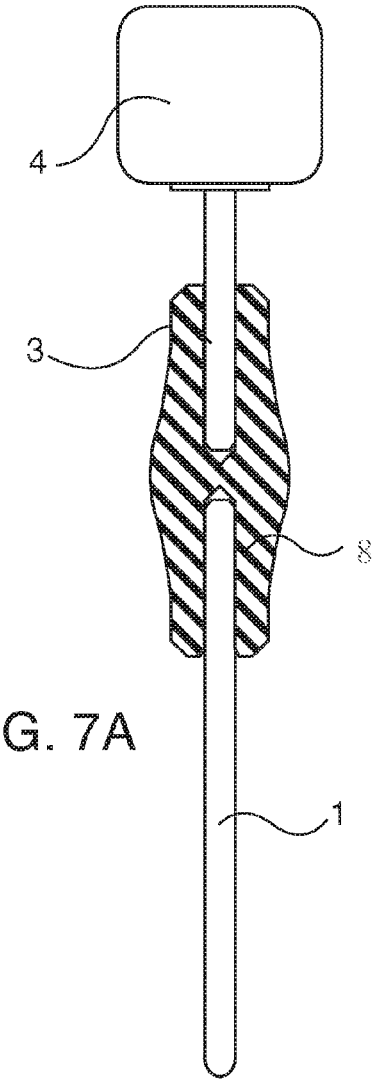
FIG. 7A is a cross section of a preferred embodiment of the present invention.

A second series of preferred embodiments of the present invention is directed to solve the uncontrolled and non-liner bounce back disclosed in the prior art by the use of an elastomeric flexible coupling material (FIG. 5, FIG. 5A and FIG. 8) and, alternatively, a thermoplastic polyurethane material (FIG. 7, FIG. 7A and FIG. 9)—each placed in between the two ends of a drum stick. In this series of preferred embodiments, an elastomeric flexible coupling 7 is used like that manufactured by Dynaflex® in place of a spring wrapped in a rubber sheath to provide both vibration and damping. FIG. 5 and FIG. 5A. Alternatively, a thermoplastic polyurethane material 8 like that produced by NINJAFLEX is used in place of a spring wrapped in a rubber sheath to provide both vibration and damping. FIG. 7 and FIG. 7A.

The elastomeric flexible coupling 7 like that manufactured by Dynaflex® bore size is matched to the drum stick 1 shaft diameter. Set screws through the outer bores of the elastomeric flexible coupling work to connect the drum stick shafts to the coupling. FIG. 5 and FIG. 5A.

The thermoplastic polyurethane material 8 like that produced by NINJAFLEX is manufactured to create a transition element between two drum stick shafts 1 and 3 with internal bores sized to match the drum stick shafts diameter. FIG. 7 and FIG. 7A. Glue is used to connect the drum stick shafts 1 and 3 to the transition element.

Figure 6:
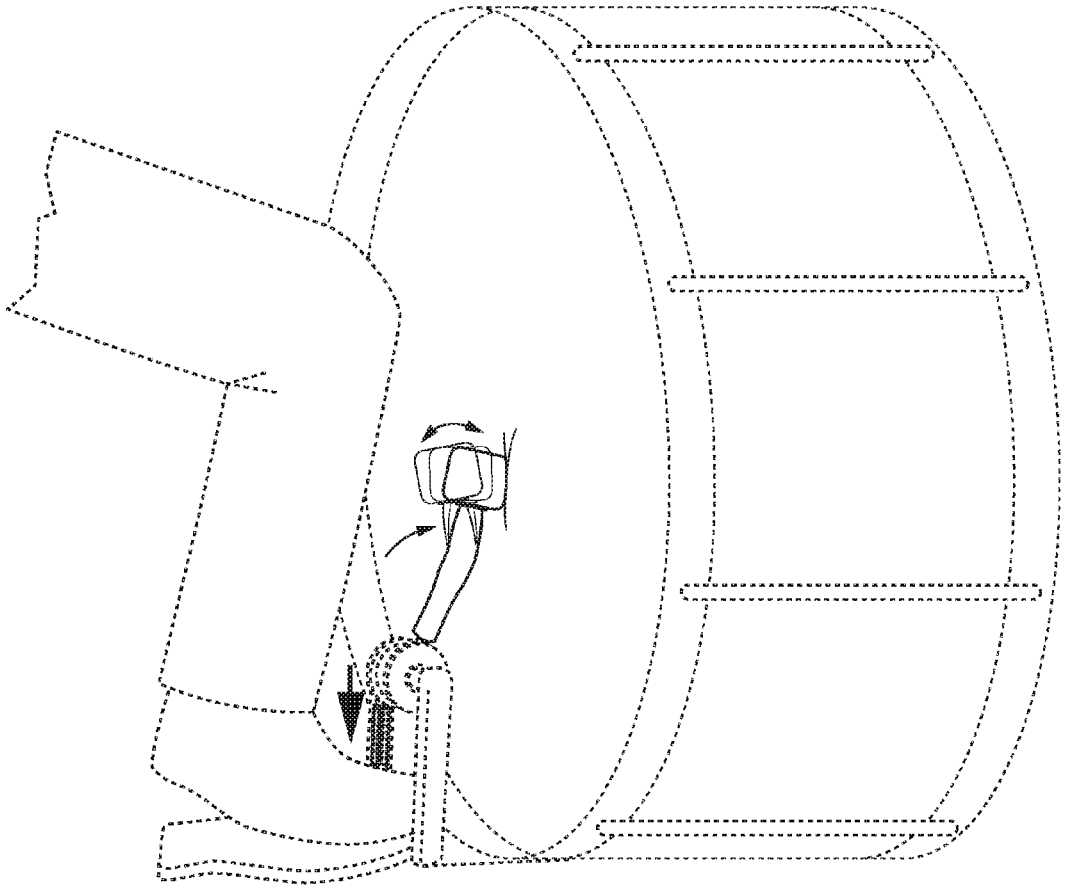
FIG. 6 is an isometric view of a preferred embodiment of the present invention inserted into a foot-pedal assembly.
Figure 8:
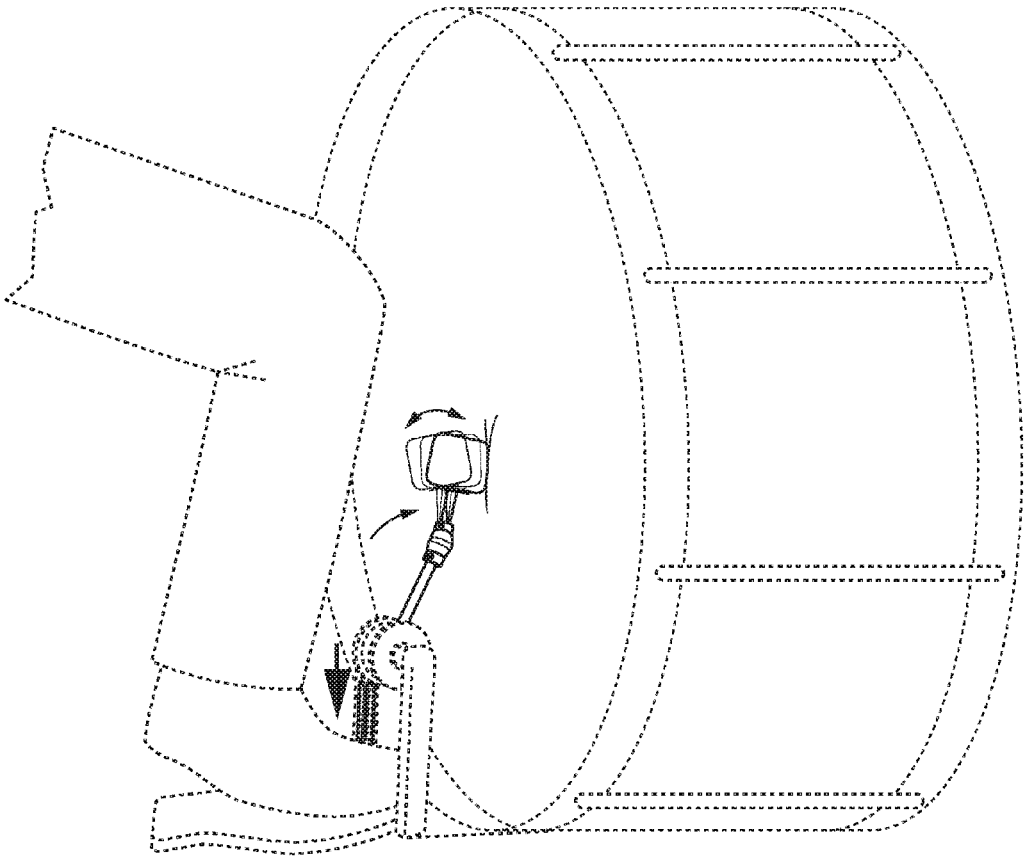
FIG. 8 is an isometric view of a preferred embodiment of the present invention inserted into a foot-pedal assembly.
Figure 9:
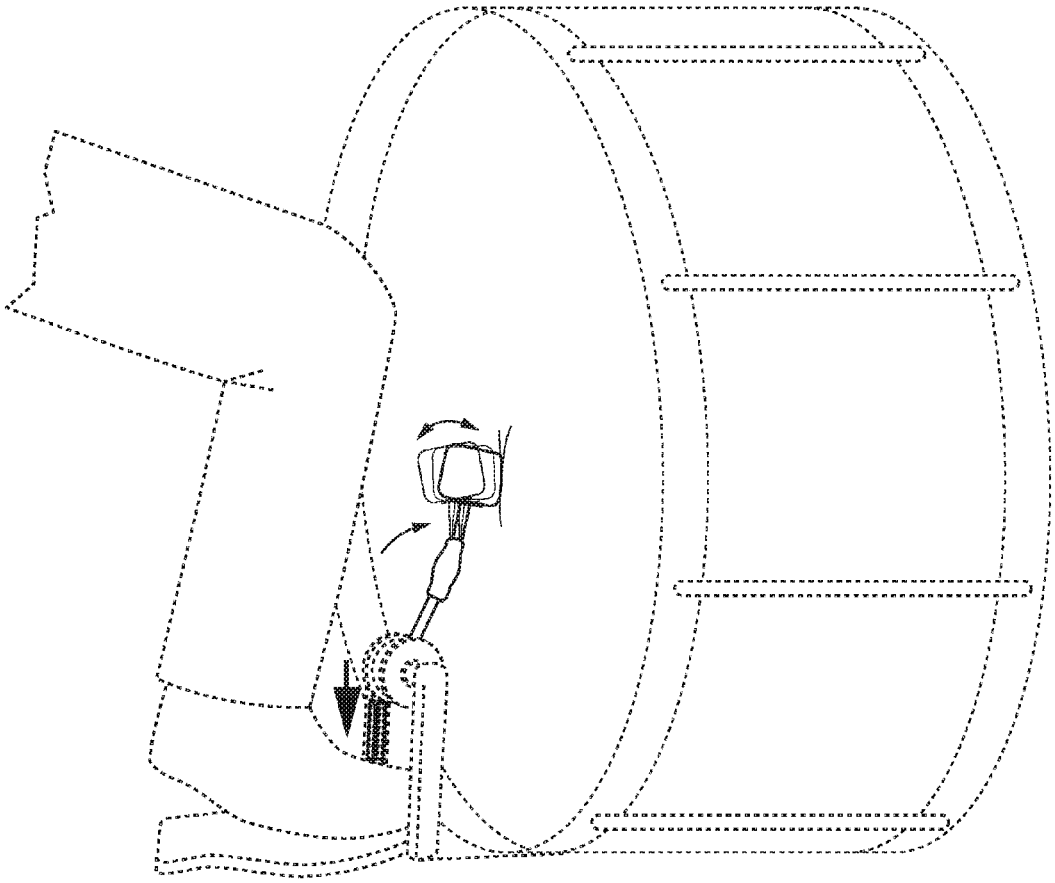
FIG. 9 is an isometric view of a preferred embodiment of the present invention inserted into a foot-pedal assembly.

In use, the operator of the foot pedal device would depress the pedal and thereby swing the drum beater device 4 of the present invention (FIG. 2, FIG. 3, FIG. 4, FIG. 5 FIG. 7A) hinged at the base of the shaft 1 into contact with a bass drum. FIG. 6 FIG. 8 and FIG. 9. At the moment of impact of the drum beater device 4 on the bass drum, the flexible joint arrangement of the present invention (FIG. 2, FIG. 3, FIG. 4, FIG. 5 and FIG. 7A) will provide an instantaneous rebound of the drum beater device 4 on the bass drum. The present invention utilizes the various flexible joint configurations of the present invention to achieve a more robust rebound which allows the musician to achieve an upstroke off of the bass drum with greater ease thereof reducing fatigue and the effort required to achieve down and upstrokes is much less than compared to conventional drum beater arrangement.

Without departing from the spirit and intent of the present invention, any of the above preferred embodiments could be adapted for use with hand held drum sticks. Further, the placement of the spring (3), universal joint (5), ball and socket joint (6), an elastomeric flexible coupling (7) and/or a thermoplastic polyurethane element (8) along the shaft 1 relative to the location of the drum beater device will provide more or less bounce of the drum beater device 4 against the bass drum. Specifically, on the hand held drum stick, optimal performance of the flexible joint is obtained when the flexible joint is located between 25% to 75% of the shaft length as measured from the tip of the drum stick. Here, again, the present invention allows the user to achieve a more natural rebound which allows the operator to achieve an upstroke off of the drum with greater ease.

Those of ordinary skill in the art will recognize that the embodiments just described merely illustrate the principals of the present invention. Many obvious modifications may be made thereto without departing from the spirit or scope of the invention as set forth in the appended claims.

What is claimed is:

1. A dynamic drum beater comprising:

A shaft with a head portion and a base portion;

the head portion of the shaft configured to receive a drum striking attachment;

the base portion of the shaft configured to receive a pivotal attachment of an actuator mechanism;

an elastomeric flexible coupling disposed between the head portion and base portion of the shaft to provide vibration of the drum striking attachment on a drum.

2. The dynamic drum beater of claim 1, wherein the actuator mechanism is a foot pedal mechanism for a bass drum.

3. A dynamic drum beater comprising:

A shaft with a head portion and a base portion;

the head portion of the shaft configured to receive a drum striking attachment;

the base portion of the shaft configured to receive a pivotal attachment of an actuator mechanism;

a thermoplastic polyurethane element disposed between the head portion and base portion of the shaft to provide vibration of the drum striking attachment on a drum.

4. The dynamic drum beater of claim 3, wherein the actuator mechanism is a foot pedal mechanism for a bass drum.

5. A method for striking a drum with a dynamic drum beater comprising:

A shaft with a head portion and a base portion; the head portion of the shaft configured to receive a drum striking attachment; the base portion of the shaft configured to receive a pivotal attachment of an actuator mechanism; an elastomeric flexible coupling disposed between the head portion and base portion of the shaft to provide vibration of the drum striking attachment on a drum;

engaging the actuator mechanism to activate the dynamic drum beater;

striking the drum with the drum striking attachment of the dynamic drum beater;

vibrating the drum striking attachment of the dynamic drum beater on the drum.

6. A method for striking a drum with a dynamic drum beater comprising:

A shaft with a head portion and a base portion; the head portion of the shaft configured to receive a drum striking attachment; the base portion of the shaft configured to receive a pivotal attachment of an actuator mechanism; a thermoplastic polyurethane element disposed between the head portion and base portion of the shaft to provide vibration of the drum striking attachment on a drum;

engaging the actuator mechanism to activate the dynamic drum beater;

striking the drum with the drum striking attachment of the dynamic drum beater;

vibrating the drum striking attachment of the dynamic drum beater on the drum.

* * * * *